US005988088A

United States Patent [19]

Ishida et al.

[11] Patent Number: 5,988,088

[45] Date of Patent: Nov. 23, 1999

[54] UNDERWATER SIGHTSEEING CRAFT

[75] Inventors: Masanori Ishida; Tadahiko Maeda, both of Hiroshima-ken, Japan

[73] Assignee: Ishida Shipbuilding and Construction Co., Ltd., Hiroshima-ken, Japan

[21] Appl. No.: 09/174,460

[22] Filed: Oct. 19, 1998

[30] Foreign Application Priority Data

Nov. 26, 1997 [JP] Japan ..... 342067
Jul. 19, 1998 [JP] Japan ..... 217812

[51] Int. Cl.[6] ..... B63B 35/00

[52] U.S. Cl. ..... 114/66; 114/61.1; 114/123

[58] Field of Search ..... 114/61.1, 61.12, 114/61.13, 66, 123

[56] References Cited

U.S. PATENT DOCUMENTS 2,525,955 10/1950 Scott ..... 114/61.13
4,423,695 1/1984 Rougerie ..... 114/66
4,548,148 10/1985 Bloomfield, III ..... 114/66
5,315,952 5/1994 Jackson, Jr. ..... 114/66
5,619,944 4/1997 Baker ..... 114/61.1

*Primary Examiner*—Stephen Avila
*Attorney, Agent, or Firm*—Lane, Aitken & McCann

[57] ABSTRACT

The present invention is characterized by an underwater sightseeing craft, wherein a plurality of displacement bodies for sightseeing equipped with underwater sightseeing rooms are provided and paralleled with a fixed distance therebetween, wherein floating cavity bodies are provided outside each of said displacement bodies, wherein whole the said bodies are combined and integrated into one body by means of connecting members so as to be in a symmetrical form, wherein sightseeing windows are formed on each of said displacement bodies for sightseeing at a fixed depth below water, and wherein said floating cavity bodies are located so as not to obstruct a view through the sightseeing windows.

4 Claims, 8 Drawing Sheets

UNDERWATER SIGHTSEEING CRAFT

TECHNICAL FIELD OF THE INVENTION

The present invention relates to an underwater sightseeing craft.

PRIOR ART

There has already been a multiple-body craft in which two displacement bodies are only paralled in a travelling direction and combined with each other by means of a connecting member. This kind of craft can easily increase stability against rolling as well as form a broad deck.

PROBLEMS TO BE SOLVED BY THE INVENTION

Using the above-mentioned advantages of the multiple-body craft, the present invention aims to provide an underwater sightseeing craft in which many passengers can embark safely and sightsee underwaters efficiently.

MEANS TO SOLVE THE INVENTION

To achieve the above objects, the present invention is characterized by an underwater sightseeing craft, wherein a plurality of displacement bodies for sightseeing equipped with underwater sightseeing rooms are provided and paralleled with a fixed distance therebetween; wherein floating cavity bodies are provided outside each of said displacement bodies, said floating cavity bodies having relatively less volume; wherein whole the bodies are combined and integrated into one body by means of connecting members so as to be in a symmetrical form; wherein sightseeing windows are formed on each of said displacement bodies for sightseeing at a fixed depth below water; and wherein said floating cavity bodies are located so as not to obstruct a view through the sightseeing windows. Here, the number of the displacement bodies for sightseeing is basically two to five.

A construction of a plurality of displacement bodies for sightseeing and two floating cavity bodies increases stability against rolling. This means that a displacement body for sightseeing located in the center of the craft receives least effects of rolling. Besides, a broad deck can be formed so that relatively large amount of passengers can safely embark on the craft.

Moreover, if the displacement bodies for sightseeing should be flooded, each of the floating cavity bodies could prevent a hull from excessively leaning and sinking, by supplementing buoyancy. If obstacles should approach from the side of the hull, the floating cavity bodies hit the obstacles and prevent them from hitting the sightseeing windows, thereby causing no damage thereon.

Furthermore, since a plurality of displacement bodies for sightseeing are equipped, it is possible to arrange sightseeing windows on opposing side faces thereof. Accordingly, passengers in one displacement body for sightseeing can see passengers in other displacement body for sightseeing through water.

In this invention, since a propulsion means is seated on each of the displacement bodies for sightseeing, the hull can turn with a small radius promptly.

PREFERRED EMBODIMENT OF THE INVENTION

FIGS. 1~5 show an underwater sightseeing craft of the present invention respectively; FIG. 1 is a front view, FIG. 2 is a side view seen from a line Y—Y in FIG. 1, FIG. 3 is a plan view cut by a line X1—X1 in FIG. 1, FIG. 4 is a plan view cut by a line X2—X2 in FIG. 1, and FIG. 5 is a plan view showing a promenade deck.

In these FIGS. 1A, 1B are examples of a pair of right and left displacement bodies for sightseeing equipped with underwater sightseeing rooms therein. Reference numbers 2A, 2B are floating cavity bodies having relatively less volume located outside the displacement bodies 1A, 1B, respectively.

These four bodies, 1A, 1B, 2A, 2B are paralleled and combined together by means of connecting box members 3 at their front and rear parts.

In this case, it is possible that the size of the floating cavity bodies 2A, 2B is about one fifth volume of the displacement bodies for sightseeing 1A, 1B. However, it is desirable that it is set so as to produce adequate buoyance larger than the hull weight in case a hull completely sinks.

Underwater sightseeing rooms 4A, 4B are formed at a submerged part of the corresponding displacemet bodies for sightseeing 1A, 1B, respectively. Sightseeing windows 5 are lined at a fixed depth below water on right and left sides of the underwater sightseeing rooms 4A, 4B, respectively, to watch underwaters therefrom.

In this case, the sightseeing windows 5 are formed so as to stand out below the bases of the floating cavity bodies 2A, 2B only for a suitable dimention "h" and not to obstruct a view through the sightseeing windows 5 with the floating cavity bodies 2A, 2B.

FIG. 3 shows that an upper deck 6 is formed at the same height as upper faces of connecting members 3 so as to surround the four bodies 1A, 1B, 2A, 2B. Reference numbers 7 are staircases combining the upper deck 6 with the underwater sightseeing rooms 4A, 4B.

As shown in FIG. 5, a promenade deck 8 provided on an upside of the upper deck 6 covers all the width and the partial length of the upper deck 6. A steering room 9 is provided on the front of the promenade deck 8.

Reference number 10 is a staircase combining the upper deck 6 with the promenade deck 8, 11 is an awning covering an upper of the promenade deck 8, 12 is a mast, 13 is a windlass, and 14 are bollards.

Machinery rooms 15 equipped with engines are provided in the rear of the displacement bodies for sightseeing 1A, 1B, respectively. Propellers 16 driven by the above engines are provided at the outer rear of the machinery rooms 15. These propellars 16 are operated by turning a control wheel in the steering room 9.

The following describes uses and effects for the above underwater sightseeing craft.

When the underwater sightseeing craft is moored to a quay, the floating cavity bodies 2A, 2B are brought alongside pier. Since the sightseeing windows 5 in the underwater sightseeing rooms 4A, 4B keep a constant distance from the quay, thereby causing no damage thereon by touch with the quay.

On embarkation, first all passengers embark on the upper deck 6, and then move into the underwater sightseeing rooms 4A, 4B, or on the promenade deck 8 through the staircase 7 or 10.

The craft is navigated by turning two right and left propellars 16, 16, and a course is generally changed by changing a direction of the propellars 16, 16. Both of the right and left propellars 16 can produce a reverse driving force, thereby turning in a small radius promptly. When sightseeing underwaters, passengers watch underwaters through the sightseeing windows 5.

The present invention comprises the four bodies 1A, 1B, 2A, 2B, thereby increasing stability against rolling of the hull greatly. This increased stability controls large heel of the hull, thereby improving the riding quality and safeties for passengers. Besides, this stability prevents the sightseeing windows 5 from being exposed above water due to a hull declivity, thereby not damaging a view through the sightseeing windows 5.

The upper deck 6 is formed so as to surround the four bodies 1A, 1B, 2A, 2B combined with each other by means of the connecting members 3, thereby providing a broad embarkation place to the passengers. This broad deck and the increased stability enable many passengers to embark.

Moreover, the hull comprising the four bodies 1A, 1B, 2A, 2B easily increases a draft in the displacement bodies for sightseeing 1A, 1B in comparison with a single body ship of the same displacement and stability. Thereby many sightseeing windows 5 can be formed at a deep position below water on side faces of the hull, and through the windows 5 many passengers can enjoy sightseeing deep in the water simultanuously.

The floating cavity bodies 2A, 2B diminish the heel of the hull, when either one of the displacement bodies for sightseeing 1A, 1B is flooded due to damage of the sightseeing windows 5. Besides, even if both of the displacement bodies for sightseeing 1A, 1B are flooded, the floating cavity bodies 2A, 2B can prevent the hull from sinking. Moreover, since these floating cavity bodies 2A, 2B act as extinguishing wave bodies, even if waves outside the floating cavity bodies 2A, 2B are big, waves between the floating cavity bodies 2A, 2B and the displacement bodies for sightseeing 1A, 1B stay smaller than waves outside the floating cavity bodies 2A, 2B, thereby especially effecting a satisfactory sightseeing environment through the sightseeing windows 5 outside the displacement bodies for sightseeing 1A, 1B.

Furthermore, since the underwater sightseeing rooms 4A, 4B are formed into a pair of the right and left displacement bodies for sightseeing 1A, 1B, and besides the sightseeing windows 5 are provided so as to oppose with each other on the displacement bodies for sightseeing 1A, 1B, passengers in the right and left underwater sightseeing rooms 4A, 4B can watch underwaters with face to face. Accordingly, passengers in one of the underwater sightseeing rooms 1A, 1B can photograph passengers watching underwaters in the other underwater sightseeing room 1A, or 1B, thereby increasing pleasure of sightseeing underwaters.

As shown in the figures, the above-mentioned embodiment relates to the craft wherein the floating cavity bodies 2A, 2B are provided and paralleled outwardly a little apart from the displacement bodies for sightseeing 1A, 1B, respectively. As shown in FIG. 6, however, the floating cavity bodies 2A, 2B can be provided so as not to obstruct a view from the sightseeing rooms of the displacement bodies for sightseeing 1A, 1B. Namely, the floating cavity bodies 2A, 2B can be paralleled and combined with the displacement bodies for sightseeing 1A, 1B, provided at a fixed height from the sightseeing windows 5.

Though the above-mentioned embodiment also relates to the craft wherein two displacement bodies for sightseeing 1A, 1B are provided, it is possible to provide three or four bodies. Namely, FIG. 7 is a side view showing a craft having three displacement bodies for sightseeing 1A, 1B, 1C; FIG. 7A shows that the floating cavity bodies 2A, 2B are provided outwardly a little apart from the displacement bodies for sightseeing 1A, 1C, and FIG. 7B shows that they are combined therewith.

In the same way as the above, FIG. 8 is a side view showing a craft having four displacement bodies for sightseeing 1A, 1B, 1C, 1D; FIG. 8A shows that the floating cavity bodies 2A, 2B are provided outwardly a little apart from the displacement bodies for sightseeing 1A, 1D, and FIG. 8B shows that they are combined therewith.

Each construction as well as effects of these embodiments having three or four displacement bodies for sightseeing 1A, 1B, 1C, or 1A, 1B, 1C, 1D is the same as the above-mentioned embodiment having two displacement bodies for sightseeing 1A, 1B.

In the same way, it is possible to provide five displacement bodies for sightseeing 1A, 1B, 1C, 1D, 1E. However, if more than these bodies are provided, the craft may be too large widthwise, thereby causing a problem in operation. Accordingly, the number of the displacement bodies is limited to five.

ADVANTAGEOUS EFFECTS OF THE INVENTION

According to thus constructed present invention, it is possible that more passengers watch underwaters pleasantly and safely in comparison with a single body ship, or a catamaran ship, each having the same displacement.

Speciffically, since the floating cavity bodies are provided on both sides of the craft, stability against rolling increases, and so the hull hardly heels. Besides, stability of the hull against waves improves and therefore prevents seasickness. Moreover, since a broad deck is secured, and the depth of draft is large, a plurality of displacement bodies for sightseeing can be formed stably deep below water so that many passengers can watch underwaters simultaneously.

Furthermore, since the floating cavity bodies are provided, even if the displacement bodies for sightseeing are flooded, the hull hardly heels and sinks.

Moreover, the present invention has a following excellent character. Since a plurality of displacement bodies for sightseeing are provided inside the floating cavity bodies with a fixed distance therebetween, passengers in one displacement body can watch passengers in other displacement body accross water and photograph this scene in response to need.

According to the invention set forth in claim 2, it is possible to promptly turn the hull with a small radius and to significantly watch underwaters.

7B show different examples wherein floating cavity bodies are fixed at different parts.

Figure 1:
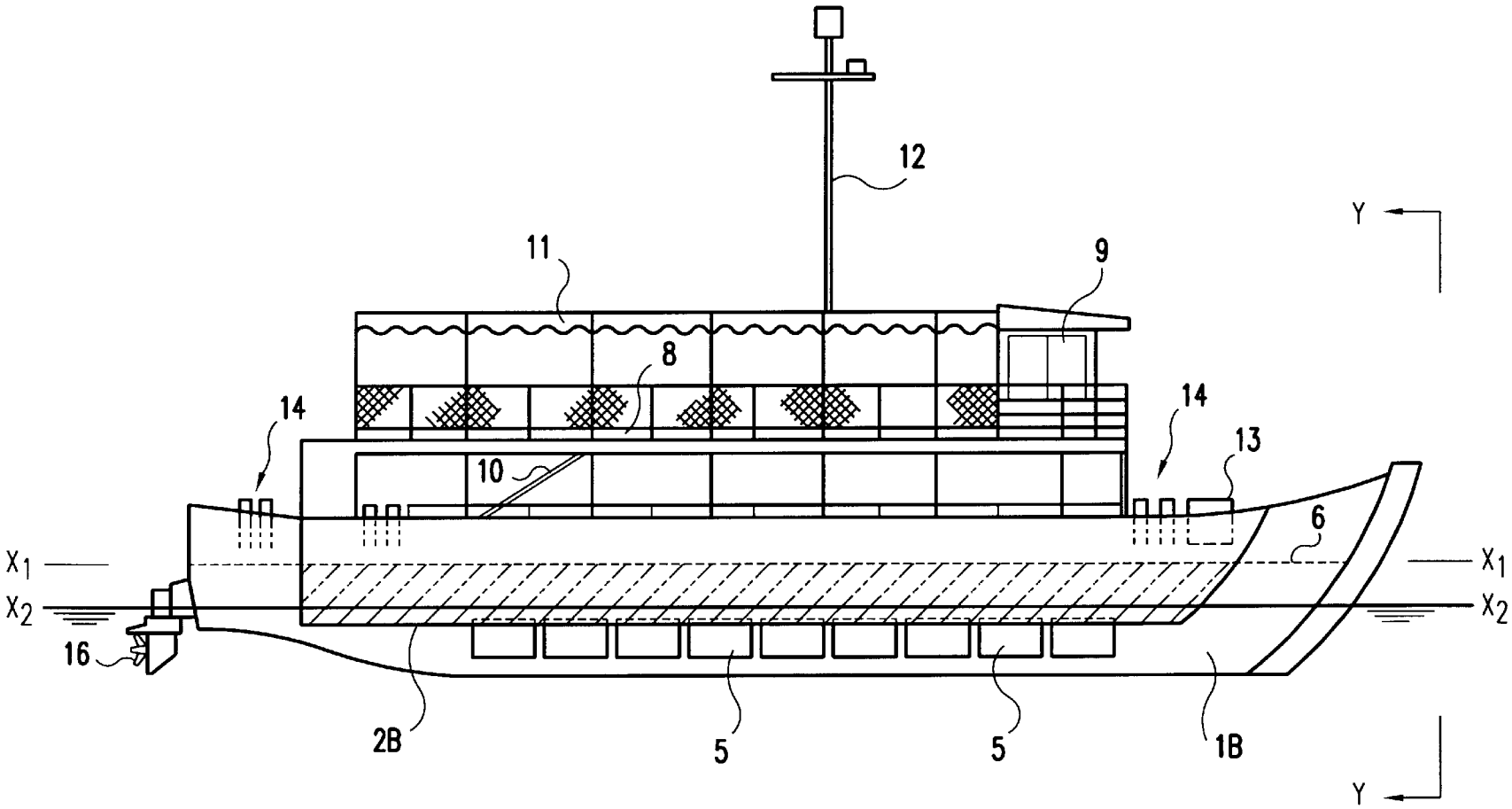
FIG. 1 is a front view showing an underwater sightseeing craft concerned in the present invention.
Figure 2:
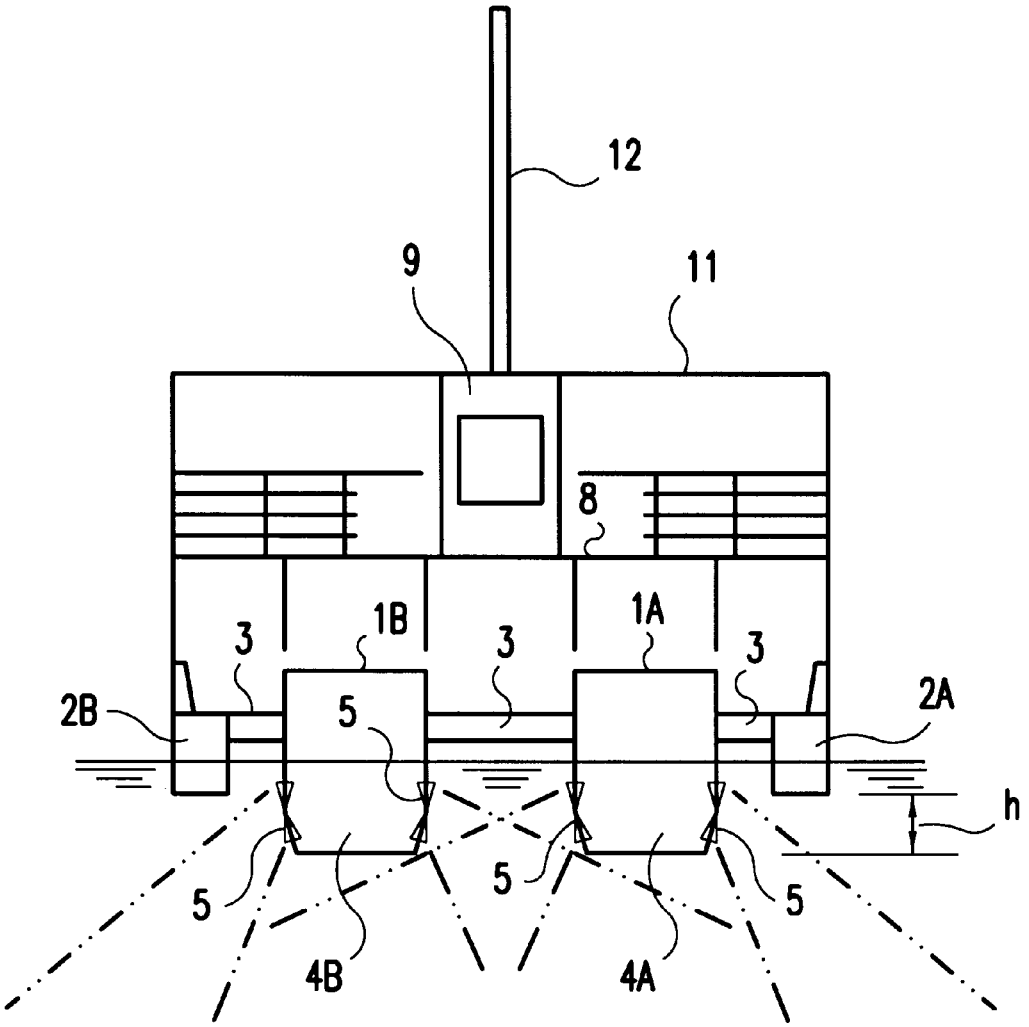
FIG. 2 is a side view seen from a line Y—Y in FIG. 1, showing the above underwater sightseeing craft wherein two displacement bodies are provided and paralleled.
Figure 3:
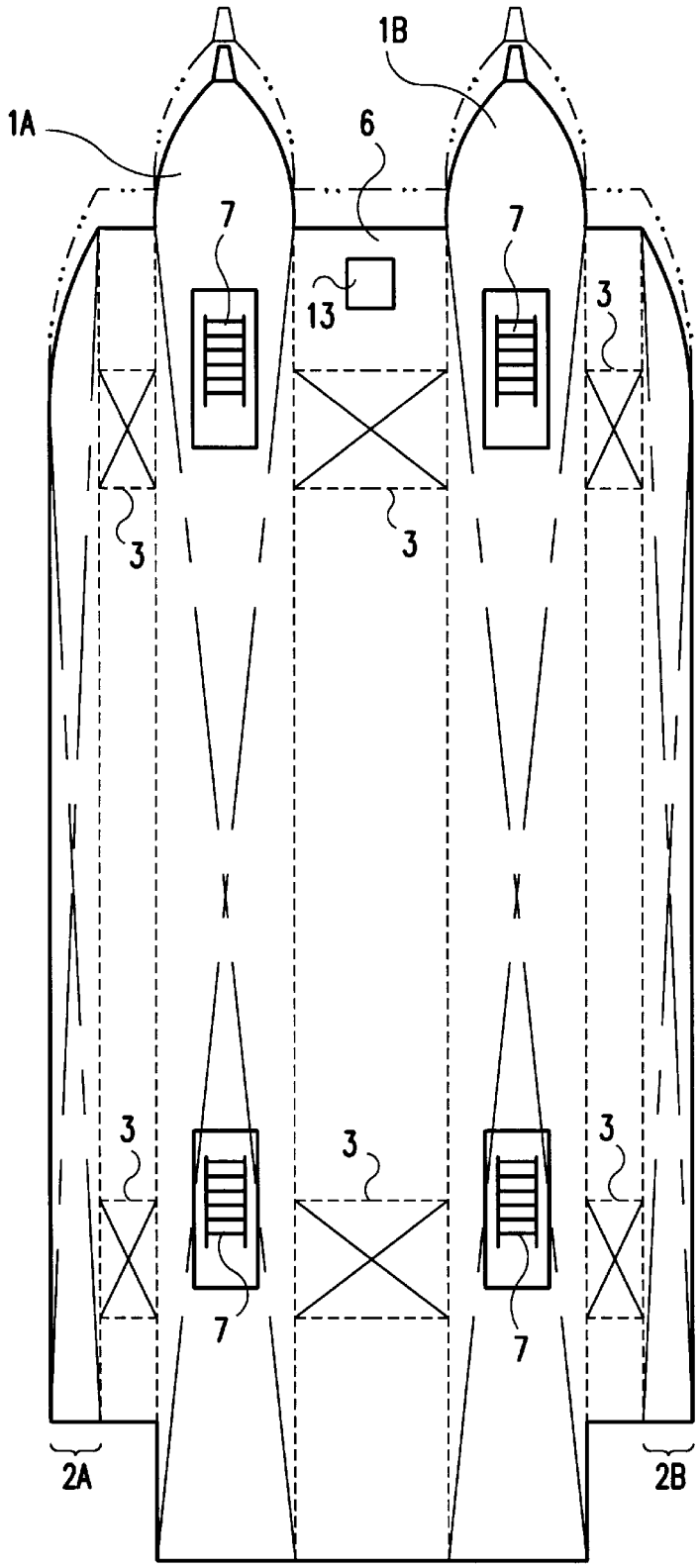
FIG. 3 is a plan view of the above underwater sightseeing craft, cut by a line X1—X1 in FIG. 1.
Figure 4:
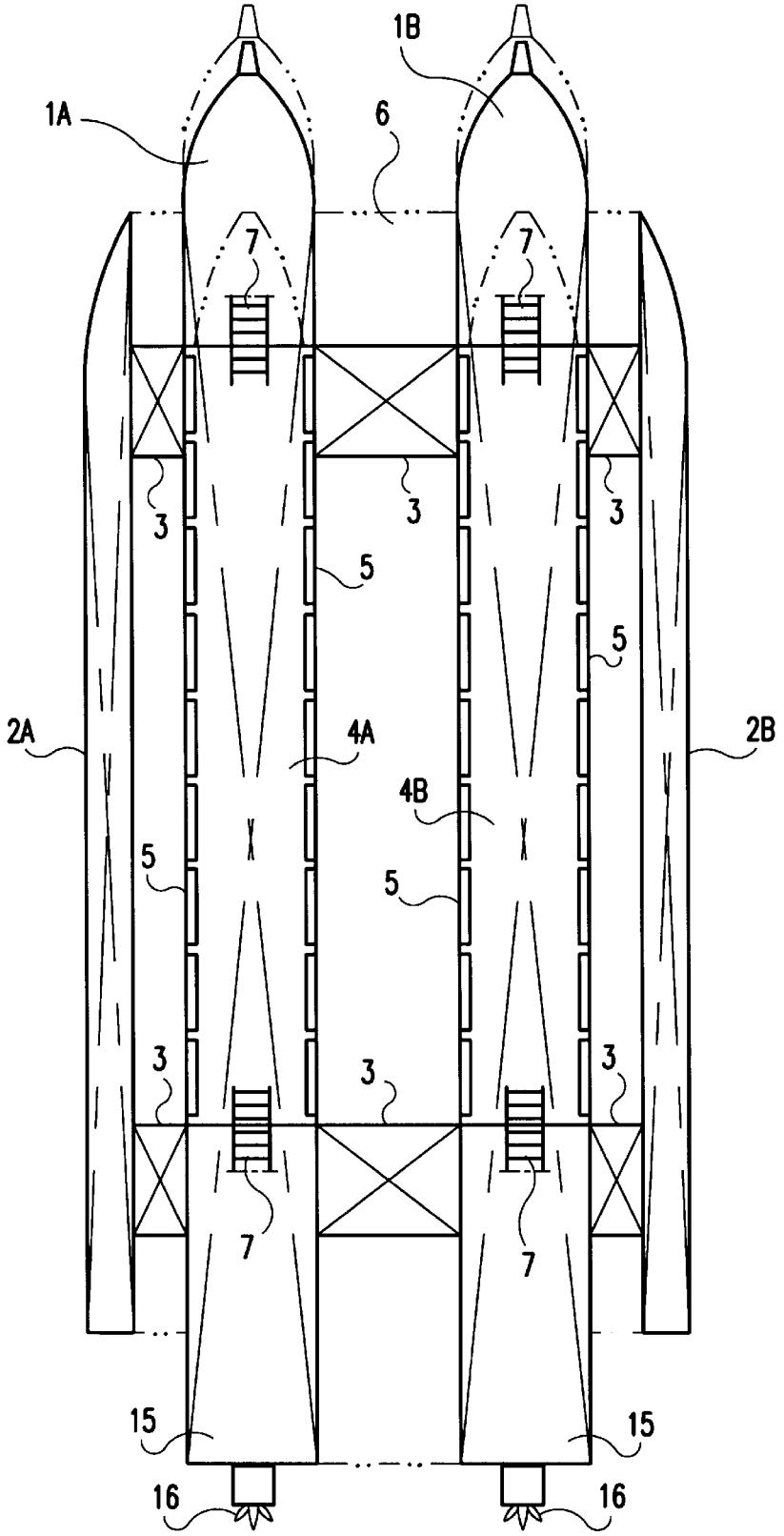
FIG. 4 is a plan view of the above underwater sightseeing craft, cut by a line X2—X2 in FIG. 1.
Figure 5:
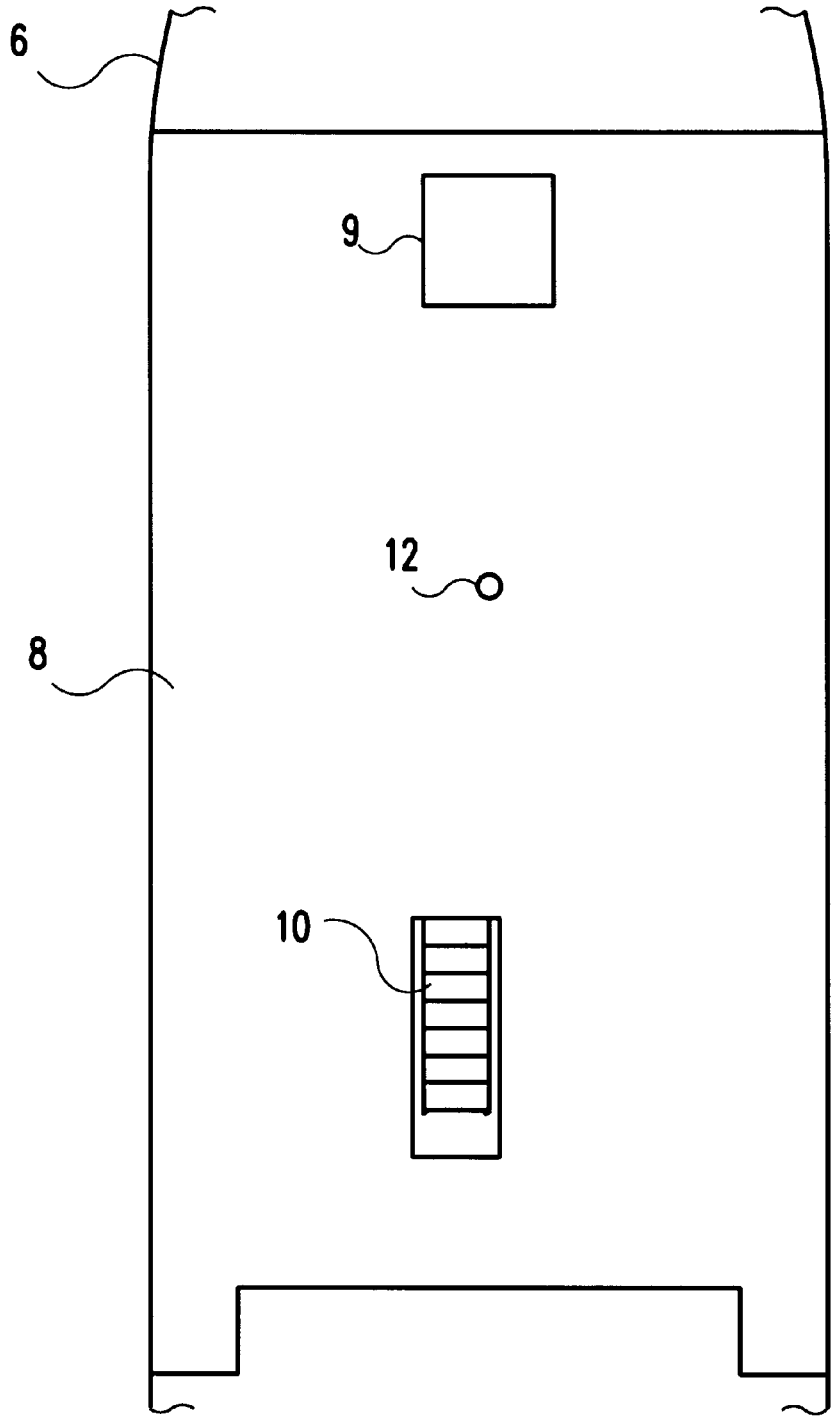
FIG. 5 is a plan view showing a promenade deck of the above underwater sightseeing craft.
Figure 6:
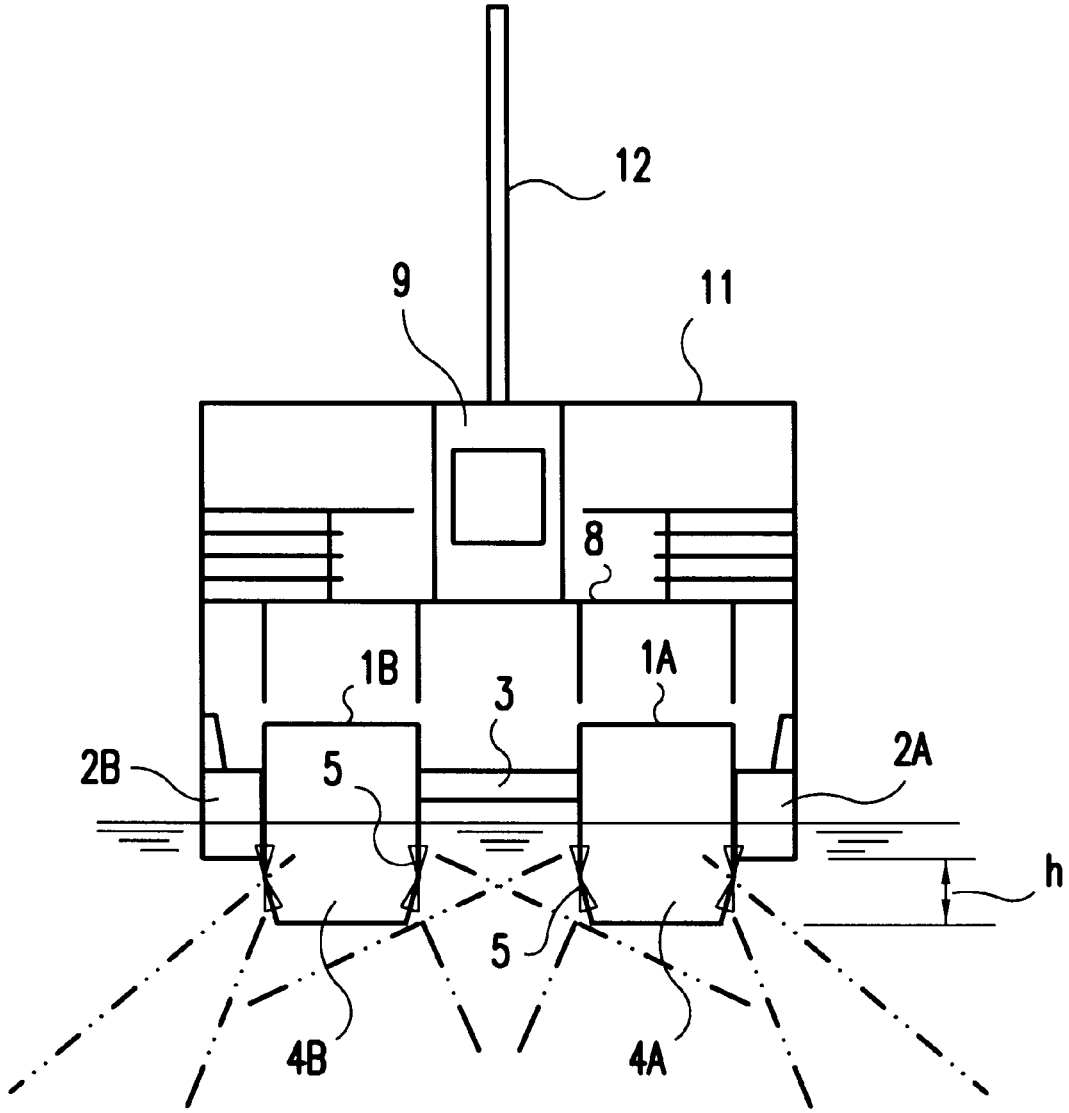
FIG. 6 is a side view showing an underwater sightseeing craft wherein floating cavity bodies are combined with displacement bodies for sightseeing thereoutside.
Figure 7A:
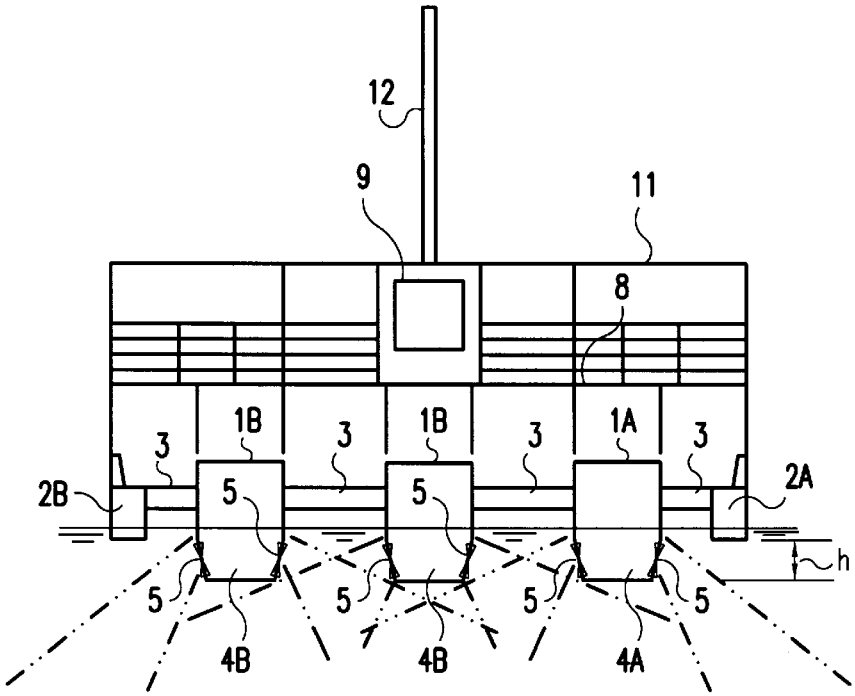
FIG. 7A and FIG.
Figure 7B:
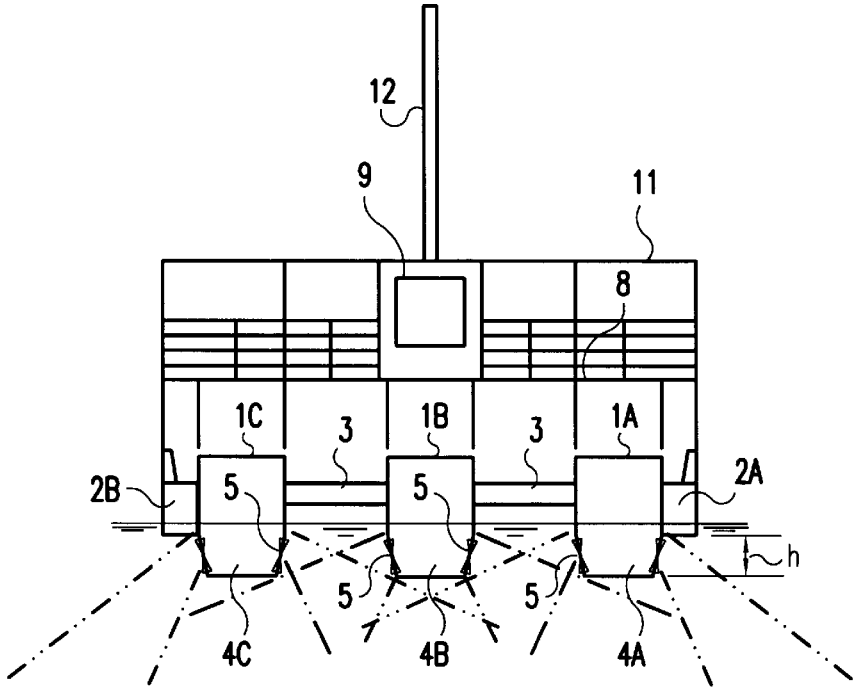
FIG. 7 shows an underwater sightseeing craft comprising three displacement bodies for sightseeing.
Figure 8A:
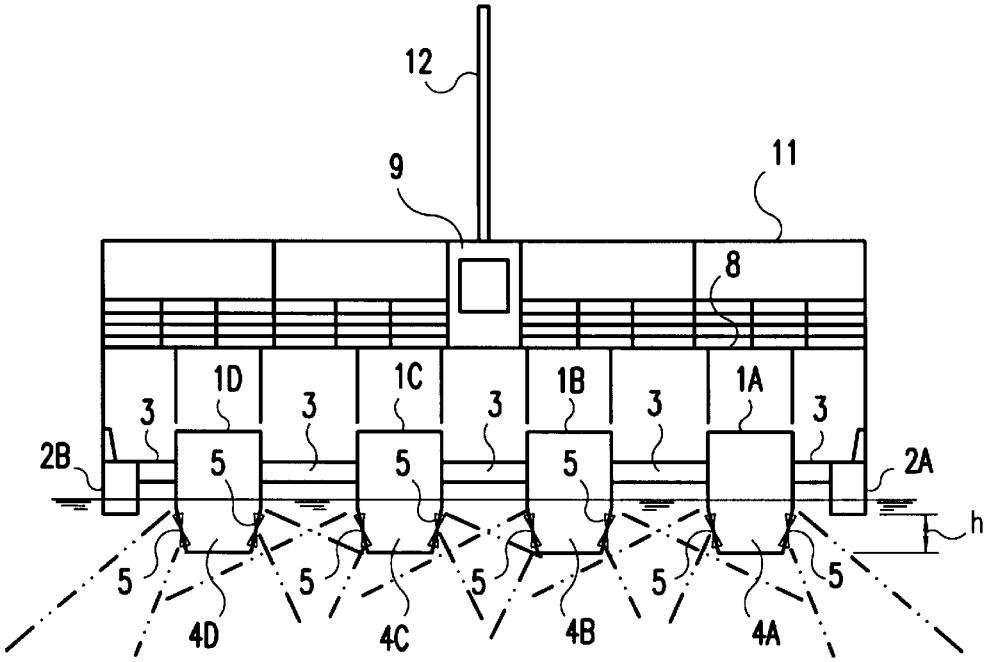
Figure 8B:
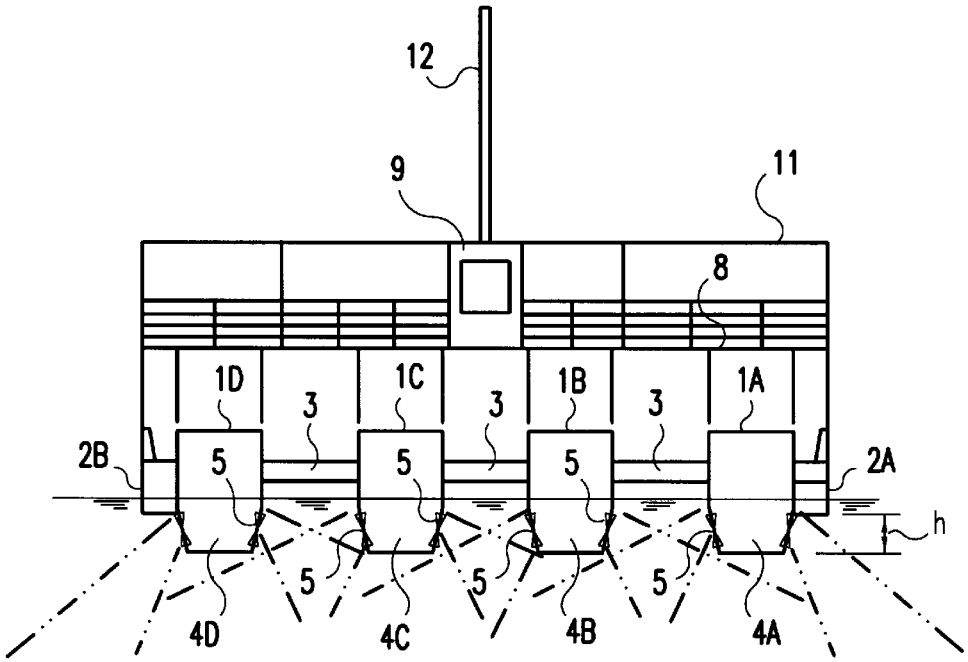

FIG. 8 shows an underwater sightseeing craft comprising four displacement bodies for sightseeing: FIG. 8A and FIG. 8B show different examples wherein floating cavity bodies are fixed at different parts.

BRIEF DESCRIPTION OF THE MARK

1A, 1B . . . a displacement body for sightseeing
2A, 2B . . . a floating cavity body
3 . . . a connecting member
4A, 4B . . . an underwater sightseeing room
5 . . . a sightseeing window
16 . . . a propeller

We claim:

1. An underwater sightseeing craft, comprising:

a plurality of displacement bodies for sightseeing, said displacement bodies having underwater sightseeing rooms, said displacement bodies being parallel to one another, with a fixed distance between one another; and floating cavity bodies outside each of said displacement bodies, wherein all of said displacement bodies and said floating cavity bodies are combined and integrated into one body in a symmetrical form by connecting members, wherein each of said displacement bodies has sightseeing windows for sightseeing at a fixed depth below water, and wherein said floating cavity bodies are fixed relative to said displacement bodies in positions not obstructing a view through the sightseeing windows.

2. An underwater sightseeing craft as set forth in claim 1:

wherein propulsion means is positioned at each of said displacement bodies for sightseeing.

3. An underwater sightseeing craft as set forth in claim 1:

wherein the number of said displacement bodies for sightseeing is two to five.

4. An underwater sightseeing craft as set forth in claim 2, wherein the number of said displacement bodies for sightseeing is two to five.

* * * * *